United States Patent [19]

Mayock

[11] Patent Number: 4,667,613

[45] Date of Patent: May 26, 1987

[54] HORIZONTAL INDUSTRIAL BOILER SYSTEM WITH IMPROVED ASH REMOVAL MEANS

[76] Inventor: John S. Mayock, 1024 Vargo La., Arlington Heights, Ill. 60004

[21] Appl. No.: 758,162

[22] Filed: Jul. 23, 1985

[51] Int. Cl.[4] ..... F22B 21/14

[52] U.S. Cl. ..... 122/327; 122/235 N; 122/346; 122/350; 122/392

[58] Field of Search ..... 110/234, 266, 166, 165 R; 122/136 R, 140 R, 142, 188, 190, 195, 235 N, 238, 331, 346, 347, 350, 379, 390, 391, 392, 324, 325, 327, 328, 15

[56] References Cited

U.S. PATENT DOCUMENTS

| | | | |
|---|---|---|---|
| 2,097,268 | 10/1937 | Best | 122/347 |
| 2,122,390 | 6/1938 | Eklund | 122/347 X |
| 2,228,590 | 1/1941 | Badenhausen | 122/347 |
| 2,256,576 | 9/1941 | Rehm | 122/347 |
| 2,350,202 | 5/1944 | Thomas | 122/392 |
| 2,630,790 | 3/1953 | Miller | 122/347 |
| 3,257,992 | 6/1966 | Bishop | 122/328 |
| 3,299,859 | 1/1967 | Dalin | 122/379 X |
| 3,518,973 | 7/1970 | Herzenberg | 122/347 X |
| 3,693,598 | 9/1972 | Cleaver | 122/347 X |

*Primary Examiner*—Albert J. Makay
*Assistant Examiner*—Steven E. Warner
*Attorney, Agent, or Firm*—Trexler, Bushnell & Wolters, Ltd.

[57] ABSTRACT

There is disclosed a boiler system in which ash-bearing fuels are fired in horizontal suspension and in which provision is made for the removal of the ash without shutting down or reducing the output of the system. The system comprises an upper water and steam drum and at least one lower water drum. A furnace cavity is located substantially between the upper drum and the lower drum, with the cavity being defined by a pair of side walls, a front wall, a rear wall, a ceiling and a floor. Means in the form of openings in the floor of the furnace cavity are located near the rear wall of the furnace cavity for permitting ash to be removed from the boiler system without requiring the shutting down or the reduction of the output of the boiler system.

19 Claims, 4 Drawing Figures

HORIZONTAL INDUSTRIAL BOILER SYSTEM WITH IMPROVED ASH REMOVAL MEANS

BACKGROUND OF THE INVENTION

This invention is directed generally to the field of horizontally-fired industrial boilers which burn an ash-laden fuel in suspension, and more particularly to a novel means for permitting ash to be removed from such a boiler system without requiring the shutting down or even the reduction of the output of the boiler system.

In many applications, it has been found to be advantageous to prefabricate an industrial boiler system at a factory rather than building it at the site where it is to be used. The size of such systems, however, is generally limited by the capabilities of the method of transportation of the prefabricated boiler system to the site. Often such systems are limited to the maximum size that a conventional railroad freight car can carry within the clearance restrictions of the route.

It has also been found to be advantageous to use an ash-laden fuel such as pulverized coal, for example, because often it is substantially cheaper than burning oil or gas. One drawback with such a fuel, however, is that it deposits an ash that lays in the furnace and fuses. This requires at least a sweeping out and possibly a jack-hammer type operation which could damage the fire brick in the floor of the boiler or, worse yet, the boiler tubes underneath the floor. This also requires the boiler to be shut down and cooled off, which results in loss of use of the boiler for at least a day in order for the workman to enter the boiler and clean it out.

Heretofore, it has been the general consensus among boiler manufacturers and operating people that a flat-bottom furnace was impractical for the removal of ash on a continous basis during operation. Systems prior to this invention which had ash removal from the furnace required a hopper bottom type boiler with tubes specially bent for this purpose and a vertical flow of gases through the furnace. The problem with the hopper-bottom type boiler is that it is very expensive to build and requires a large slag tank in the bottom of the boiler which is also expensive. Hopper-bottom boiler systems usually require the vertical flow of combustion gases in the furnace. A vertical, hopper-bottom boiler system therefore generally must be built to such a size that it is very impractical, if not impossible, to prefabricate it and ship it to the site. This means that the vertical, hopper-bottom boiler system must be erected at the site where it is to be used, thus further increasing the cost of the system.

Another approach to the problem is to fire the fuel horizontally in the boiler, with the boiler having a flat bottom furnace. U.S. Pat. No. 2,097,268 illustrates such a system. Current state-of-the-art technology in burners and pulverizers has permitted the use of a single burner and a single pulverizer for capacities of up to and in excess of 100,000,000 BTU's per hour in a boiler which also have turn-down capabilities previously only possible with multiple-burner and multiple-pulverizer operations. U.S. Pat. Nos. 4,387,654; 4,310,299; and 4,184,640 disclose examples of burners and pulverizers for solid fuel. By using a single burner and a single pulverizer the capital cost of such a project is greatly reduced. Up to now, however, this technology has been hampered by the fact that this equipment is most effectively used in a horizontally-fired, flat-bottom boiler which heretofore had no means of continuous ash removal. Accordingly, as will be shown hereinafter in greater detail, the present invention complements the advances in technology in the burner and pulverizer fields.

OBJECTS AND SUMMARY OF THE INVENTION

Accordingly, it is a general object of this invention to provide a new and improved horizontally-fired industrial boiler system.

It is a more particular object of this invention to provide a horizontally-fired industrial boiler system which has novel means for permitting ash to be removed from the boiler system without requiring the shutting down or even the reduction of the output of the boiler system.

It is an additional object of the present invention to provide such a horizontally-fired industrial boiler system in which pulverized coal or other ash-bearing fuels may be burned in suspension in a flat-bottom boiler system, which is less expensive to build than a conventional hopper-bottom system.

It is a further object of the present invention to provide such a horizontally-fired industrial boiler system which may be fabricated in a factory rather than at the site where the system is ultimately used.

In accordance with a first aspect of the invention, there is provided a boiler system in which ash-bearing fuels are fired in horizontal suspension and in which provision is made for the removal of the ash without shutting down or reducing the output of the system. The system comprises an upper water and steam drum and at least one lower water drum. A furnace cavity is located substantially between the upper drum and the lower drum, with the furnace cavity further having a pair of side walls, a front wall, a rear wall, a ceiling and a floor. A plurality of substantially vertical inner water tubes connect the upper drum with the lower drum, with the tubes being longitudinally spaced from the front to the rear of the furnace cavity to at least partially form the side walls thereof. Means are provided at the front wall of the furnace cavity for burning ash-bearing fuel in horizontal suspension to create a flow of hot combustion gases that is directed horizontally towards the rear of the furnace cavity. Means are located near the rear wall of the chamber for permitting ash to be removed from the boiler system without requiring the shutting down or the reduction of the output of the boiler system.

In accordance with another aspect of the invention, a new and improved boiler system is provided in which ash-bearing fuels are fired in horizontal suspension and in which provision is made for the removal of ash without shutting down or reducing the output of the system. The system includes a furnace cavity having a pair of side walls, a front wall, a rear wall, a ceiling, and a floor. An upper water and steam drum located near the top wall of the furnace cavity is provided, as well as a pair of lower water drums located near the floor of the furnace cavity, with the first lower water drum being located near one side wall of the furnace cavity and the second lower water drum being located near the other side wall of the furnace cavity. A plurality of substantially vertical inner water tubes connect the upper water and steam drum with the lower water drums, with the tubes being longitudinally spaced from the front to the rear of the furnace cavity. Some of these water tubes extend substantially vertically from the upper water and steam drum downwardly, forming one of the side walls, to one of the lower water drums. At least some of the remaining water tubes extend substantially vertically from the upper water and steam drum downwardly, forming the other side wall, to the other lower water drum. Means are located near the front wall of the chamber for burning ash-bearing fuels in horizontal suspension to create a flow of hot combustion gases that is directed horizontally towards the rear of the furnace cavity. Openings are provided in the floor of the furnace cavity, whereby the ash that is deposited from the hot combustion gases falls through the openings without requiring the shutting down or the reduction of the output of the boiler system.

In accordance with yet another aspect of the invention, a horizontal, industrial boiler system is provided in which ash-bearing fuels are fired in horizontal suspension and in which provision is made for the removal of ash without shutting down or reducing the output of the system. Such a system includes a furnace cavity having a pair of side walls, a front wall, a rear wall, a ceiling, and a floor. An upper water and steam drum is located near the ceiling of the furnace cavity, while a pair of lower water drums are located near the floor of the furnace cavity, with the first lower water drum located near one side wall of the furnace cavity and the second lower water drum located near the other side wall of the furnace cavity. A plurality of substantially vertical inner water tubes connect the upper water and steam drum with the lower water drums, the tubes being longitudinally spaced from the front to the rear of the furnace cavity. At least some of the water tubes extend toward one of the side walls, then substantially vertically, forming the side wall, and then substantially horizontally forming the floor of the furnace cavity and terminating in the lower water drum located on the opposite side wall of the furnace cavity. A convection zone is concentrically disposed adjacent to and outside of the furnace cavity, with this zone having therein a plurality of substantially vertical outer water tubes connecting the upper and lower water drums. Means are located near the front of the furnace cavity for burning ash-bearing fuels in horizontal suspension to create a flow of hot combustion gases that is directed horizontally towards the rear of the furnace cavity. Finally, openings near the rear of the floor of the furnace cavity are provided in both the horizontal water-tube extensions, which form the floor, whereby the ash that that is deposited from the hot combustion gases falls through both of these openings without requiring the shutting down or the reduction of the output of the boiler system.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figure 1:
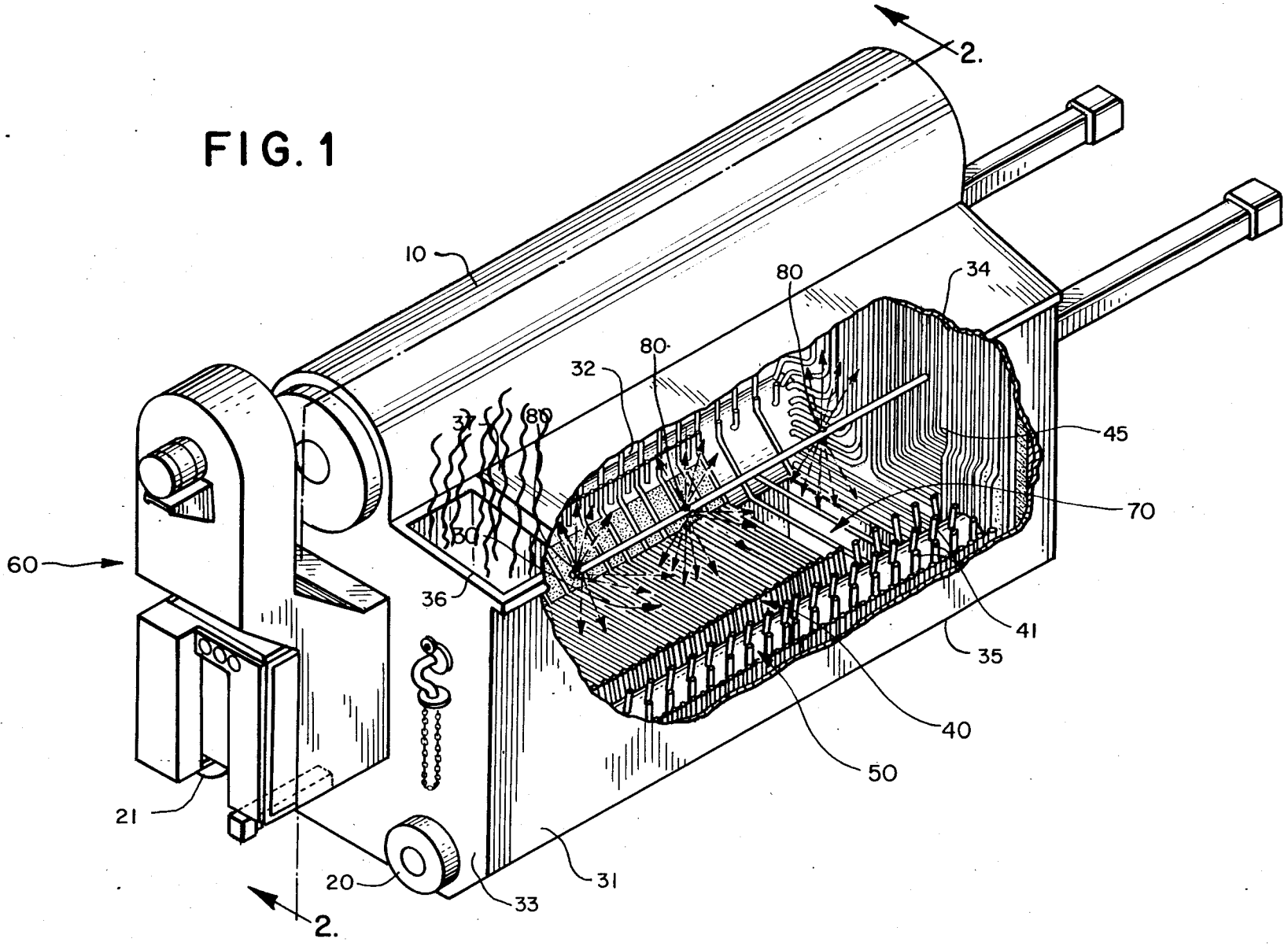
FIG. 1 is a perspective view, partially broken away, of a horizontal industrial boiler system constructed in accordance with the present invention.
Figure 4:
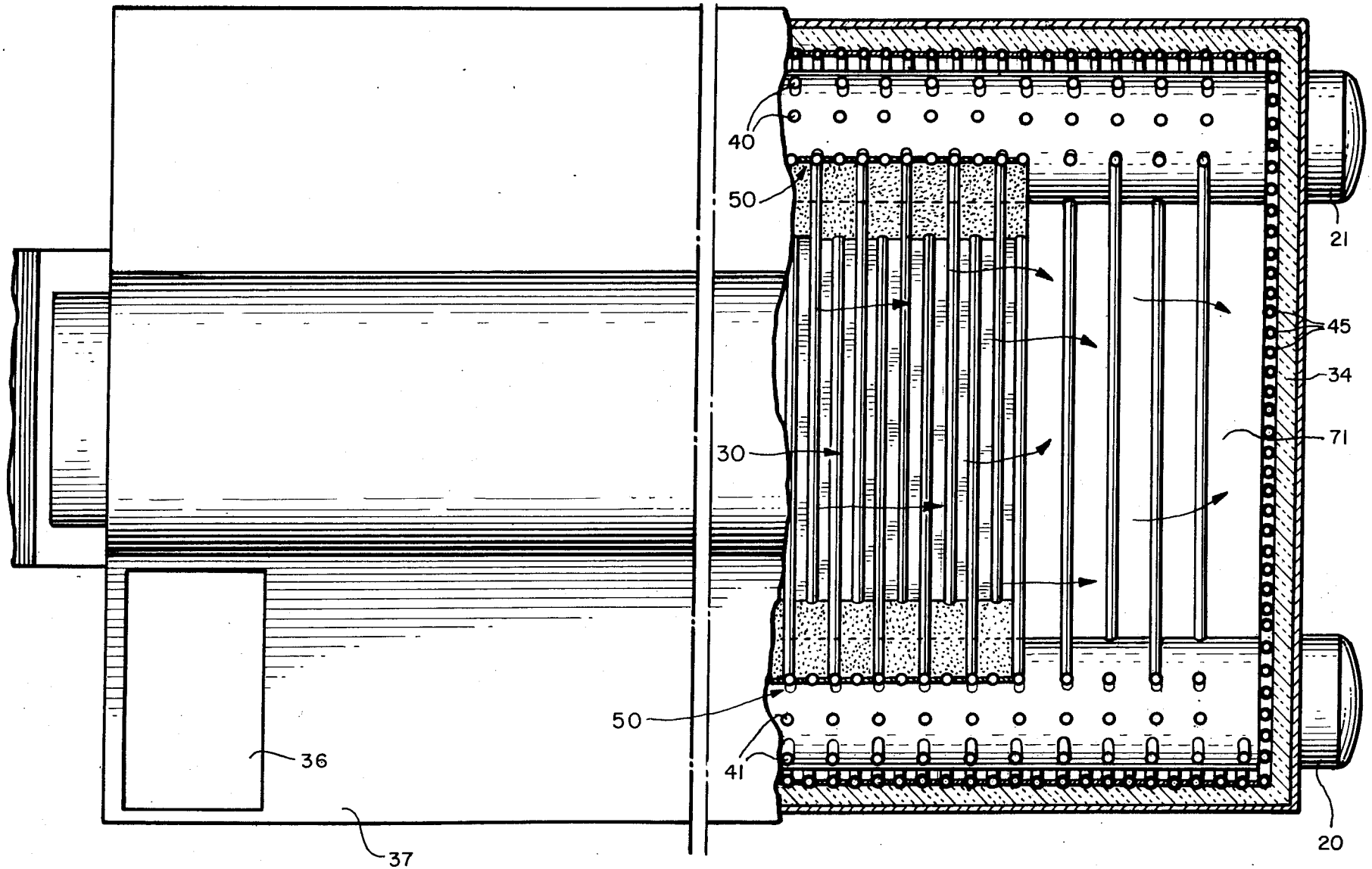
FIG. 4 is a top view, partially broken away, of a horizontal industrial boiler system constructed in accordance with the present invention.

Referring now to the drawings, and initially to FIG. 1, a novel boiler system constructed in accordance with the features of the present invention so that ash-bearing fuels are fired in horizontal suspension and which provides for the removal of the ash without shutting down or even reducing the output of the system. The illustrated embodiment includes an upper water and steam drum 10 and at least one lower water drum 20. A furnace cavity 30 is located substantially between the upper drum 10 and the lower drum 20. Furnace cavity 30 has a front wall 33 and a rear wall 34. A plurality of substantially vertical water tubes 40 (sometimes referred to as "furnace tubes") connect upper drum 10 with lower drum 20. As shown in FIGS. 1 and 4, tubes 40 are longitudinally spaced from the front to the rear of furnace cavity 30 to at least partially define a furnace cavity 30, including the side walls thereof, its floor, and most of its ceiling. For clarity, portions of tubes 40 have been broken away so that the interior of the furnace cavity 30 may be seen. Burner means 60 are provided at the front wall 33 of furnace cavity 30 for burning ash-bearing fuel in horizontal suspension to create a flow of hot combustion gases that is directed horizontally towards the rear wall 34 of furnace cavity 30. The housing for the entire boiler system is completed by sides 31, 32 and a bottom 35. An opening 36 is provided in the top 37 of the boiler housing to permit the spent gases to be exhausted.

The exhausted gases may be conveyed to further processing devices such as scrubbers, economizers, or filters. Neither these devices nor the burner are shown in detail because they are conventional and do not form an important part of the invention.

Finally, and in accordance with one important aspect of the present invention, means 70 are located near the rear wall 34 of furnace cavity 30 for permitting ash to be removed from the boiler system without requiring the shutting down or the reduction of the output of the boiler system. Ash-removal means 70 illustrated in FIG. 1 comprises openings in the bottom furnace cavity 30, which openings are formed by eliminating some of the horizontally-extending portions of tubes 40 that form the floor of the furnace cavity 30. The ash thus may fall into a pit 71 (see FIG. 2), and then may be removed from the pit 71 in a conventional manner without interfering with the operation of the boiler system in any way.

In operation, the burner means 60 is attached to the front wall 33 of the furnace cavity 30 so that the hot combustion gases flow from the front of furnace cavity 30 toward the rear wall 34. This flow of gas helps to carry the ash towards the back of the furnace cavity 30 where the ash-removal means 70 is located. Near the rear of the furnace cavity 30 the flow of hot combustion gases makes a 180-degree turn to travel, through a convection zone 50, back toward the front wall 33. In the illustrated embodiment of the invention, the convection zone 50 is concentrically disposed adjacent to and outside of the furnace cavity 30. Of course, other configurations for the convection zone may be employed without departing from the principles of the present invention. The furnace cavity 30 and the convection zone 50 are separated by a panel of water-cooled surfaces, either membrane, studded or tangent vertical furnace tubes 40. When the hot combustion gases make the 180-degree turn, this reversal of the flow of gases enhances the degree of ash fallout near the ash-removing means 70. In addition, ash-moving means 80 are provided to effectively cause a sweeping action to blow ash which sticks to the tubes or falls to the bottom of the furnace cavity 30 towards the rear wall 34 and thus into the ash-removing means 70.

The furnace volume required for this boiler necessitates the use of a boiler which, if fired with a fuel containing no ash, would make approximately two to two and a half times as much steam. Therefore, by making a boiler system in accordance with the present invention, it will have two to two and a half times as much convection heating surface as compared with a conventional, horizontally-fired, ash-less fuel boiler system. Alternatively, much of the convection heating surface in the convection zone in the boiler could be removed to thereby enhance the ability to keep the convection zone of the boiler clean by lowering the velocity of the hot combustion gases passing through the convection zone 50. This also will lower the erosion caused by the scrubbing action of the ash particles against the tubes.

Figure 3:
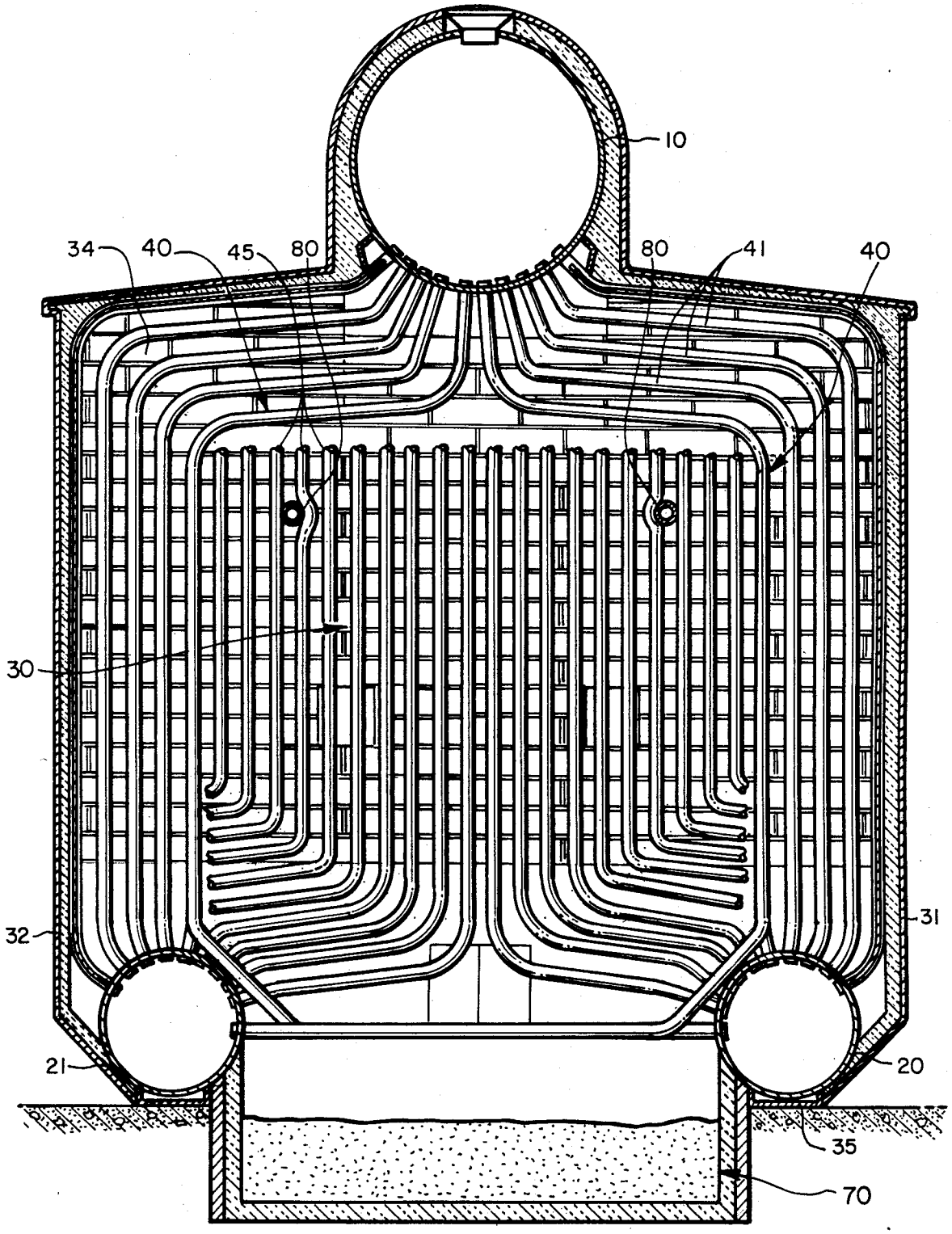
FIG. 3 is a sectional view taken substantially in the plane of line 3—3 in FIG. 2.

More particularly, upper water and steam drum 10 forms part of a closed-loop steam system (not shown) to supply heat for various industrial uses. Drum 10 also forms part of a closed-loop water and steam system which includes a pair of lower water drums 20, 21 (more clearly shown in the sectional view of FIG. 3) which are connected via a plurality of substantially vertical inner water tubes 40 and substantially vertical outer water tubes 41. In the embodiment of the invention illustrated in FIG. 1, tubes 40 generally form the side walls, ceiling and floor of furnace cavity 30. As the hot combustion gases flow horizontally through furnace cavity 30 towards the rear wall 34, the radiant heat from the hot combustion gases heats the water in the inner or furnace water tubes to such a degree that steam bubbles are generated in the water in those tubes. As mentioned hereinabove, the hot combustion gases make a 180-degree turn at the rear wall 34 and flow through the convection zone 50 toward the front wall 33. As these gases flow horizontally through convection zone 50, they transfer heat to the water in substantially vertical outer water tubes 41 (sometimes referred to as "convection" tubes). As heat is transmitted from these gases to the water in the water tubes, the gases naturally become cooler to the point where no steam bubbles are generated, particularly in the water in the outer water tubes closer to the front wall 33.

Because the water with the steam bubbles in it is less dense than the steam-free water, a natural circulation is established whereby the less-dense water rises to upper water and steam drum 10 through the furnace tubes 40 and some of the convection tubes 41 (sometimes referred to as "risers"), and the denser, steam-free water flows to the lower water drums 20, 21 through the remaining ones of convection tubes 41 (sometimes referred to as "downcomers"). Thus there is a continuous flow of water such that the less-dense water is transferred to the upper drum 10 where the steam bubbles separate from the water and become available for use as steam. The denser, steam-free water is conveyed from drum 10 down to the lower water drums 20, 21 by the "downcomers", and then through the "risers" to be reheated and returned to upper drum 10. Additional water tubes 45 are provided at the rear of furnace cavity 30 adjacent the rear wall 34 to increase the amount of radiant heat transfer and to protect the rear wall 34 from damage due to radiant heat and ash bombardment.

In accordance with another feature of the present invention, the inner or furnace water tubes 40 are crisscrossed such that some of tubes 40 extend from upper drum 10 toward one side wall of cavity 30 and then substantially vertically to form a side wall of cavity 30, and then substantially horizontally to form the floor of cavity 30 and terminating in lower water drum 21 which is located near the opposite side wall of cavity 30. Preferably, and as shown in the drawings, particularly FIGS. 1, 2 and 4, tubes 40 alternate, for each side of cavity 30, so that one tube connects upper drum 10 with lower drum 20 and the next adjacent tube connects upper drum 10 with lower drum 21. The alternation of the tubes 40 is reversed on the other side of cavity 30 so that the horizontal "crossing" portions of tubes 40 interlace. To enhance the direction of the flow of the hot combustion gases through furnace cavity 30, the lower, horizontal portions of tubes 40 may be tangentially connected (or joined together by membranes). Such a structure also prevents the hot combustion gases and ashes from penetrating the floor of furnace cavity 30 and damaging the portions of the boiler system below the furnace cavity 30.

Figure 2:
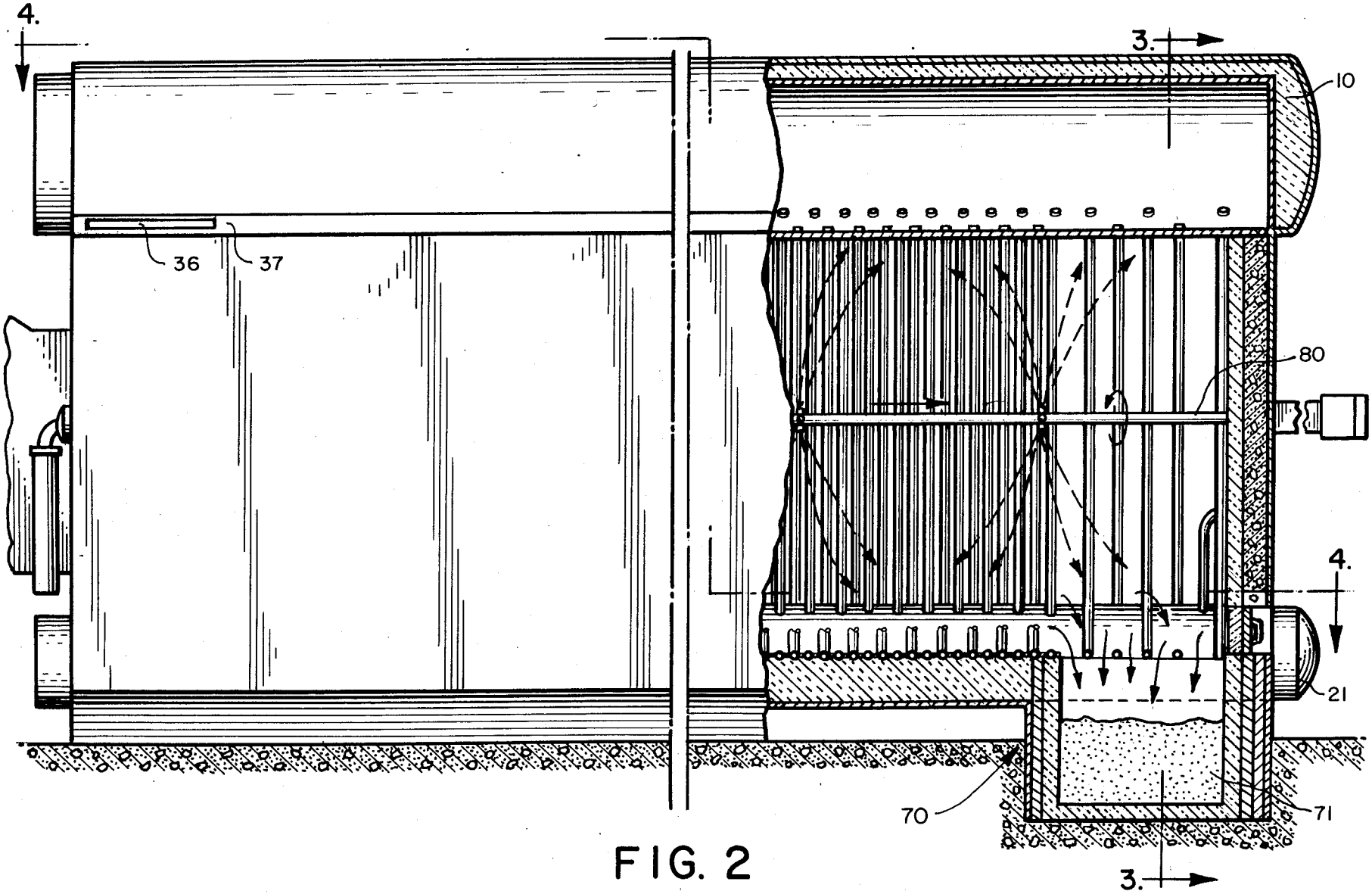
FIG. 2 is a sectional view taken substantially in the plane of line 2—2 in FIG. 1.

In accordance with an important aspect of the invention, the lower, horizontal portions of tubes 40 near the rear of chamber 30 are not connected so that openings are formed through which the ashes may be removed from the furnace cavity without interfering with the operation of the boiler system. Moreover, such openings may be enlarged by omitting some of the lower, horizontal portions of tubes 40 near the rear of chamber 30 as shown in FIGS. 1, 2 and 4 to enhance ash removal.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim of the appended claims is to cover all such changes and modifications as fall within the true spirit and scope of the invention.

The invention is claimed as follows:

1. A boiler system in which ash-bearing fuels are fired in horizontal suspension and in which provision is made for the removal of the dry ash without shutting down or reducing the output of the system, said system comprising:

an upper water and steam drum;

at least one lower water drum;

a furnace cavity located substantially between said upper drum and said lower drum, said cavity extending substantially the full length of the boiler and being defined by a pair of side walls, a front wall, a rear wall, a ceiling and a solid floor;

a plurality of substantially vertical inner water tubes connecting said upper drum with said lower drum, said tubes being longitudinally spaced from said front wall to said rear wall to at least partially form the side walls of said furnace cavity;

a convection zone disposed outside said substantially vertical inner water tubes and substantially parallel thereto; said convection zone having therein a plurality of substantially vertical outer water tubes connecting said upper drum with said lower drum;

burner means near the front wall of said furnace cavity for firing ash-bearing fuel in horizontal suspension to create a flow of hot combustion gases that is directed horizontally towards the rear wall of said furnace cavity and then through at least a portion of said convection zone;

means located near the rear wall of said furnace cavity for permitting dry ash to be removed from said boiler system without requiring the shutting down or the reduction of the output of said boiler system; and means for guiding said flow of hot combustion gases from the rear of said furnace cavity, into said convection zone, and then back towards the front of said convection zone, such that this reversal of the flow of hot combustion gases enhances the degree of dry ash fallout near said ash-removing means prior to said hot combustion gases flowing to an exit located near the front of said furnace cavity.

2. A boiler system in accordance with claim 1, which further includes ash-moving means to aid in transporting the dry ash toward the rear wall of said furnace cavity where the ash-removing means is located.

3. A boiler system in accordance with claim 1, in which the lower portion of said vertical inner water tubes connecting said upper water drum with said lower water drum means extend in a substantially horizontal manner so as to form the bottom of said furnace cavity.

4. A boiler system in accordance with claim 1, in which said ash-removing means comprises an opening in the floor of said furnace cavity.

5. A boiler system in accordance with claim 1, in which said lower water drum means comprises two water drums, with the first of said lower water drums being located near one side of said furnace cavity and the second of said water drums being located near the other side of said furnace cavity, both of said lower water drums being disposed substantially between the front and rear walls of said furnace cavity.

6. A boiler system in accordance with claim 5, in which some of said substantially vertical inner water tubes extend downwardly, forming one of said side walls of said furnace cavity to a location near said first lower water drum and then extend in a substantially horizontal fashion to connect to said second lower water drum.

7. A boiler system in accordance with claim 6, in which at least some of the remaining vertical inner water tube extend downwardly, forming the other of said side walls, to a location near said second lower water drum and then extend in a substantially horizontal manner to connect to said first lower water drum.

8. A boiler system in accordance with claim 7, in which the horizontally-extended portions of said water tubes are tangentially joined together to form a substantially flat horizontal floor for said furnace cavity.

9. A boiler system in which ash-bearing fuels are fired in horizontal suspension and in which provision is made for the removal of dry ash without shutting down or reducing the output of the system, said system comprising:

a furnace cavity extending substantially the full length of the boiler and having a pair of side walls, a front wall, a rear wall, a ceiling, and a solid floor;

a convection zone disposed outside of and adjacent to said inner vertical water tubes and substantially parallel thereto; said convection zone having therein a plurality of substantially vertical outer water tubes connecting said upper drum with said lower drum;

an upper water and steam drum located near the ceiling of said furnace cavity;

a pair of lower water drums located near the floor of said furnace cavity, with the first lower water drum being located near one side wall of said furnace cavity and the second lower water drum being located near the other side wall of said furnace cavity;

a plurality of substantially vertical inner water tubes connecting said upper water and steam drum with said lower water drums, said vertical inner tubes being longitudinally spaced from said front wall to said rear wall in said furnace cavity, some of said inner water tubes extending substantially vertically from said upper water and steam drum downwardly to form one of said side walls and then connecting to one of said lower water drums, and at least some of the remaining ones of said inner water tubes extending substantially vertically from said upper water and steam drum downwardly to form the other one of said side walls and then connect to the other of said lower water drums;

burner means located near the front wall of said chamber for firing ash-bearing fuels in horizontal suspension to create a flow of hot combustion gases that is directed horizontally towards the rear wall of said furnace cavity;

means at said rear wall for directing said gases through said convection zone toward the front of said boiler system such that this reversal of the flow of hot combustion gases enhances the degree of dry ash fallout prior to said hot combustion gases flowing to an exit located near the front of said furnace cavity; and an opening in said floor near the rear of said furnace cavity, whereby the dry ash deposited from said hot combustion gases falls through said opening without requiring the shutting down or the reduction of the output of said boiler system.

10. A boiler system in accordance with claim 9, which further includes ash-moving means to aid in moving the dry ash toward the rear wall of said furnace cavity where the ash-removing means is located.

11. A boiler system in accordance with claim 9, in which the lower portion of said vertical inner water tubes connecting said upper water drum with said lower water drum means extend in a substantially horizontal manner so as to form the bottom of said furnace cavity.

12. A boiler system in accordance with claim 9, in which some of said vertical inner water tubes extend downwardly and substantially parallel to one of said side walls to a location near said first lower water drum and then extend in a substantially horizontal fashion to said second lower water drum.

13. A boiler system in accordance with claim 12, in which at least some of the remaining vertical water tubes extend downwardly and substantially parallel to the other of said side walls to a location near said second lower water drum and then extend in a substantially horizontal manner to said first lower water drum.

14. A boiler system in accordance with claim 13, in which the horizontally-extended portions of said water tubes are tagentially joined together to form a substantially flat horizontal floor for said furnace cavity.

15. A boiler system in accordance with claim 14, in which said horizontally-extended portions of said water tubes are joined such that they form a continuous surface that prevents hot combustion gases and dry ashes from penetrating the floor of said furnace cavity.

16. A horizontal, industrial boiler system in which ash-bearing fuels are fired in horizontal suspension and in which provision is made for the removal of dry ash without shutting down or reducting the output of the system, said system comprising:

a furnace cavity extending substantially the full length of the boiler and having a pair of side walls, a front wall, a rear wall, a ceiling, and a solid floor;

a convection zone concentrically disposed adjacent to and outside of said furnace cavity, said convection zone having therein a plurality of substantially vertical outer water tubes connecting said upper drum with said lower drum;

an upper water and steam drum located near the ceiling of said cavity;

a pair of lower water drums located near the floor of said furnace cavity, with the first lower water drum located near one side wall of said furnace cavity and the second lower water drum located near the other side wall of said furnace cavity;

a plurality of substantially vertical inner water tubes connecting said upper water and steam drum with said lower water drums, said tubes being longitudinally spaced from the front wall to the rear wall of said furnace cavity to at least partially define a wall between said furnace cavity and said convection zone, with at least some of said vertical inner water tubes extending toward one of said side walls, then extending substantially vertically to form said one of said side walls extending down to a location near said first lower water drum, and then extending substantially horizontally and parallel to form the floor of said furnace cavity and terminate in said second lower water drum located on the opposite side wall of said furnace cavity, thus at least partially defining the top, sides and bottom of said furnace cavity;

burner means located near the front of said furnace cavity for firing ash-bearing fuels in horizontal suspension to create a flow of hot combustion gases that is directed horizontally towards the rear of said furnace cavity;

an opening in the floor near the rear of said furnace cavity, whereby the dry ash that falls out of said hot combustion gases falls through said opening without requiring the shutting down or the reduction of the output of said boiler system, and means for guiding said flow of said hot combustion gases from the rear of said furnace cavity through said convection zone, such that this reversal of the flow of hot combustion gases enhances the degree of dry ash fallout near said ash-removing means prior to said hot combustion gases flowing to an exit located near the front of said furnace cavity.

17. A boiler system in accordance with claim 16, which further includes ash-moving means to aid in moving the dry ash toward the rear wall of said chamber where the ash-removing means is located.

18. A boiler system in accordance with claim 16, in which at least some of the remaining vertical inner water tubes extend toward the other one of said side walls, then extend substantially vertically, to form said other side wall, to a location near said second lower water drum, and then extend substantially horizontally and parallel to become part of said floor of said furnace cavity and to terminate in said first lower water drum.

19. A boiler system in accordance with claim 18 in which approximately one-half of said vertical water tubes are connected to said first lower water drum and the other half of said vertical water tubes are connected to said second lower water drum.

* * * * *